United States Patent [19]

van der Scheer

[11] Patent Number: 4,536,735

[45] Date of Patent: Aug. 20, 1985

[54] CURRENT LIMITING HIGH VOLTAGE FUSE ASSEMBLY

[75] Inventor: Derk van der Scheer, Goor, Netherlands

[73] Assignee: Hazemeijer B.V., Hengelo, Netherlands

[21] Appl. No.: 580,352

[22] Filed: Feb. 15, 1984

[30] Foreign Application Priority Data

Feb. 16, 1983 [NL] Netherlands ..... 8300581

[51] Int. Cl.[3] ..... H01H 85/04

[52] U.S. Cl. ..... 337/159; 337/158; 337/297

[58] Field of Search ..... 337/158, 159, 161, 297, 337/293, 295, 164, 166

[56] References Cited

U.S. PATENT DOCUMENTS 3,713,063 1/1973 Foulkes ..... 337/159
3,801,945 4/1974 Howard ..... 337/159

FOREIGN PATENT DOCUMENTS 1588923 12/1970 Fed. Rep. of Germany .
1072509 9/1954 France .
2392488 12/1978 France .
7802199 8/1979 Netherlands .
1184056 4/1970 United Kingdom .
2067855 7/1981 United Kingdom .

*Primary Examiner*—Harold Broome
*Attorney, Agent, or Firm*—Watson, Cole, Grindle & Watson

[57] ABSTRACT

The invention relates to an assembly for a current limiting high voltage fuse, comprising a preferably tubular support body (1), consisting of quartz glass, and fusible conductors (2) attached over their entire length to the support body, which conductors (2) are of a width of minimum 0.5 mm and maximum 1 mm and of a thickness of maximum 50 μm.

These fusible conductors are applied in parallel paths, the distance between the paths being at least twice as large as the width of the fusible conductors. Also the fusible conductors are provided with narrow sections (4) separated in longitudinal direction of the fusible conductor over regular distances, and interconnected at both ends by an electrically conducting sleeve (3) applied to the support body (1).

11 Claims, 1 Drawing Figure

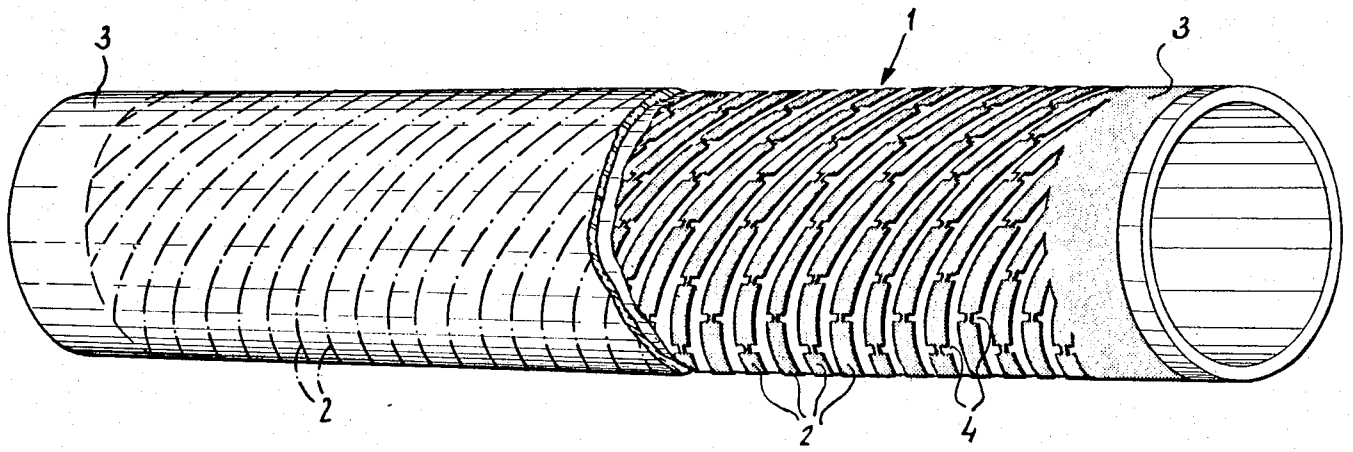
3
1
4
2
2
3

CURRENT LIMITING HIGH VOLTAGE FUSE ASSEMBLY

BACKGROUND OF THE INVENTION

1. Field of the Invention

The invention relates to a assembly for a current limiting high voltage fuse, comprising a preferably tubular support body consisting of quartz glass and fusible conductors attached over their entire length to the support body.

2. The Prior Art

A similar assembly is known from published Dutch Patent application No. 7802199. Fuses which have been manufactured with one or more of the above-mentioned assemblies present a number of advantages, such as simple and compact construction, in particular when concentric tubes are used for the support body. The fusible conductors are less vulnerable, due to their support by the support body, and a better arcextinguishing action is obtained as a consequence of the smaller space. Besides, quartz glass has the advantage that also with high temperatures the insulation resistance hardly decreases, while it has a low coefficient of expansion.

However, fuses manufactured with such an assembly are not suitable to be used as current limiting fuses in high frequency networks, in particular because of their inability to effectively interrupt low overload currents. Low overload currents are those which lie somewhere between twofold and tenfold of the rated current. When a low overload current is not effectively interrupted, that is to say when the low overload current can flow over a too long time through the fuse, the generated arc energy can become so large that eventually the fuse will explode.

SUMMARY OF THE INVENTION

The object of the present is to provide an assembly as stated above, in which all advantages are maintained, but by means of which also low overload currents can be interrupted without the noted disadvantages.

It is also an object of the present invention to effectively interrupt overload currents in the range between the minimum fuse current and the mentioned low overload currents.

This object is achieved by at least one assembly of the kind mentioned above, characterized in that (a) the fusible conductors are of a width of minimum 0.5 mm and maximum 1 mm;

(b) the thickness of the fusible conductors is maximum 50 μm;

(c) the fusible conductors are applied in parallel paths and the distance between the paths is at least twice as large as the width of the fusible conductors;

(d) the fusible conductors are provided with narrow sections separated in longitudinal direction over regular distances.

In the assembly of the present invention the width, the thickness and the mutual distance of fusible conductors having several narrow sections have been chosen such that also for a low overload current, as well as lower overload currents ranging below the overload current, produce the effect of short circuit currents for each fusible conductor as a consequence of the commutation action known per se.

Commutation action means that, as soon as one of the fusible conductors fuses, for instance one of its narrow sections, the current is taken over by the other fusible conductors, which current increases herein and leads to the fusing of a narrow section of a further fusible conductor. In this way the current commutates several times, until the last not yet interrupted fusible conductor, as a consequence of the considerable current, will fuse simultaneously at several locations, by which several small arcs in series are generated and a fast arc built up of arc voltage will take place, so that the current will be interrupted. Hereafter one of the conductors, fused before at one location, will reignite at the location. The reignited fusible conductor will take over the current conduction and will interrupt the current in the same way. The commutation process will continue until, finally, all interrupted fusible conductors are of such voltage resistance, that no reignition can occur anymore.

In case of a high short circuit current, as a matter of course all fusible conductors will fuse simultaneously in the normal way and not by the noted commutation effect.

The basic idea to interrupt lower overload currents by using several parallel fusible conductors is knon per se from the article "Strombegrenzende Hochspannungs-Hochleistungssicherungen mit sicherer Ausschaltung im Bereich kleiner Ueberströme" of R. Seysen, published in Conti Elektro-Berichte, January/June 1968. The knowledge published in this article is only partly used, notwithstanding the still existing problem of interrupting low overload currents. In the cited article it is proposed to limit the number of fusible conductors to six, which mainly is determined by the available space within the cartridge, by the rated voltage and by the production-technical possibilities.

One of the most important reasons why the basic idea, known per se, which in essence is correct, did not lead to an adequate solution, can be traced back to the way the several parallel fusible conductors are supported. Up till now the conductors were surrounded by loose granular filling material, see Dutch Patent Application No. 8006084, or by means of star-shaped support bodies of insulating material. This has a number of disadvantages. In the fusible conductors strength reducing mechanical tensions occur constantly by differences in coefficient of expansion with constant temperature changes. The strength, also determined by the necessity that the separate fusible conductors to be entirely or partly self-supporting, affects the minimum conductor cross section which may not exceed a certain minimum limit, and this determines the lowest overload current to be interrupted. The application of a support body supporting the fusible conductors across their entire length allows much smaller cross sections of the fusible conductors and allows a much larger number of fusible conductors to be applied, so that the range of the currents to be interrupted is considerably broadened downwardly.

In particular a support body of quartz glass has appeared to be advantageous for the application of the assembly of the present invention. The advantages are known per se from the previously noted Dutch Patent Application No. 7802199. However, in this citation only a small number of parallel fusible conductors are used, allowing no interruption of low overload currents.

The maximum division in parallel fusible conductors of the present invention, possible by the use of a support body, also means that the arc energy upon fusing will be divided much more over the total length of the fusible conductor and consequently over the cooling medium, i.e., sand, so that the length of the fusible conductor may become smaller with the voltage remaining equal. When using silver this means a considerable saving of material and is consequently also cost-reducing. When applying the assembly of the present invention in a fuse for a voltage of 12 kV, the length of the fusible conductor amounts to between 500 and 600 mm. Lengths used up till now were between 600 and 700 mm.

In an assembly of the present invention the number of parallel fusible conductors is preferably at least fourteen. The mutual distance of the fusible conductors, determined by their width and their number, can be reduced so far without adversely affecting the interruption effect until the fuse beads developed during fusing of the fusible conductors start to touch one another. The fuse beads may not grow to unite because this will obstruct the heat-discharge, which unfavorably affects the interruption ability of the fuse. The dimensions of the fuse beads as a matter of course also depend on the thickness of the fusible conductor, so that this thickness also determines the minimum distance between the fusible conductors.

The ratio between the width of the narrow sections in the fusible conductors and the width of the fusible conductors is preferably 1:2.5. The narrow sections of two adjoining fusible conductors are preferably not opposite one another. The most favourable operation is obtained if the narrow sections in adjoining fusible conductors are at a maximum mutual distance.

In both ends of an assembly the fusible conductors are preferably interconnected by an electrical conducting sleeve attached to the support body and extending over a part of or over the total circumference of the support body. This is given preference to separately soldering each fusible conductors or to the use of clamps. Also the production of an assembly is considerably simplified and the disadvantages of solder connections, amongst which ageing, are avoided.

For the application of the fusible conductors and the sleeves upon the support body a silkscreen printing process is preferably employed. This enables an exact predetermined pattern to be applied upon a support body within very close tolerances. Thus one can control completely as to how narrow the fusible conductors have to be, which shape, location and dimension one wants to give to narrow sections in the fusible conductors and how close to one another the fusible conductors should be located. Besides, this process is very well reproducible. Subsequently, by means of a galvanic deposition process, by thickening the layer thus obtained, the applied electrical conducting paths can be adapted to a certain rated current.

The desired thickness of the fusible conductors can be fully controlled then by continuously measuring the electrical resistance of the paths. Only in this way has it has become possible to exactly apply upon a support body the theoretically determined optimum conducting material for a predeterment current interruption situation. Especially when using a support tube, the silkscreen printing technique appeared to be very favourable. The fusible conductors adhere very well to the surface of the support tube, and when using quartz glass the differences in expansion do not lead to too high mechanical tensions.

When using fuses with an assembly of the present invention there will be no problem of mechanical ageing.

Furthermore the quartz glass support material is very arcresistant.

The use of silkscreen printing in fuses is known per se, see for instance British Pat. No. 1,184,056. This application, however, relates to weak current and/or low voltage conditions. The thickness and the printed pattern are of no interest here. Up till now the silkscreen printing has never been applied with high voltages.

The drawing shows a perspective view of an assembly of the present invention.

The system consists of a tubular quartz glass support body 1. On the outer surface of the support body 1 fusible conductors 2 and at both ends sleeves 3 are applied by means of silkscreen printing. After silkscreen printing the pattern, consisting of the fusible conductors 2 and sleeves 3, the electrically conducting layers are thickened by means of a galvanic process until the desired cross section is obtained.

Such an assembly can be mounted in in a fuse with a housing and end cap constructions at both ends. These are not indicated here.

Reference number 4 refers to the narrow sections in the fusible conductor. The number of narrow sections shown here should be considered as an example only. The width of the narrow sections to the total width of the fusible conductor is preferably in the ratio of 1:2.5. With this ratio an ideal interruption occurs, during which all narrow sections upon a short circuit conductor will fuse simultaneously, whereas for low overload currents the commutation effect will run extremely favourable. The FIGURE also shows the most favourable location of the narrow sections in the various fusible conductors, such that in adjoining fusible conductors the distances between the narrow sections are maximum. This will result in a most favourable heat-discharge.

The number of parallel fusible conductors 2 may also be larger than indicated. With a greater number their length may be reduced, which results in saving of material.

Instead of a tubular support body, one or more parallel flat support bodies may be used, which are preferred under certain circumstances.

It is obvious that also several shown assemblies may be mounted co-axially in one fuse, as described in the above-mentioned Dutch Patent Application No. 7802199.

I claim:

1. An assembly for use in a current limiting high voltage fuse, said assembly comprising an elongated support body composed of quartz glass, and a plurality of elongated fusible conductors attached over their entire lengths to said elongated support body so as to be parallel to one another, each said elongated fusible conductor including a plurality of elongated first sections having a first width and a plurality of regularly spaced-apart second sections having a second width, said second width being less than said first width, each of said first and second sections having the same predetermined thickness, said first width being between 0.5 and 1 mm and said predetermined thickness being up to 50 μm, said elongated fusible conductors being spaced apart a distance equal to at least twice their first widths.

2. An assembly as defined in claim 10, wherein said support body is tubular.

3. An assembly as defined in claim 2, wherein said elongated fusible conductors are helically oriented around said tubular support body.

4. An assembly as defined in claim 1, wherein the ratio of said second widths to said first widths is 1 to 2.5.

5. An assembly as defined in claim 1, wherein said elongated fusible conductors are attached to said elongated support body such that each second section of each elongated fusible conductor is aligned with an elongated first section of each adjacent elongated fusible conductor.

6. An assembly as defined in claim 5, wherein each of said elongated first sections of each elongated fusible conductor has a predetermined length, and wherein the second section of each elongated fusible conductor is aligned with the midpoint along the length of the elongated first section of each adjacent elongated fusible conductor.

7. An assembly as defined in claim 1, wherein at least 14 elongated fusible conductors are attached to said elongated support body.

8. An assembly as defined in claim 1, wherein said elongated support body has opposite ends, wherein said elongated support body includes electrically-conducting sleeves near its respective opposite ends, and wherein each of said plurality of of elongated fusible conductors is connected at its opposite ends to a respective sleeve.

9. An assembly as defined in claim 8, wherein each said sleeve extends entirely around said elongated support body.

10. A method of manufacturing an assembly useful in a current limiting high voltage fuse, said method comprising the steps of (a) providing an elongated support body composed of quartz glass, (b) silkscreen printing a plurality of elongated fusible conductors on said elongated support body so as to be parallel to one another, each said fusible conductor including a plurality of elongated first sections having a first width and a plurality of regularly spaced-apart second sections having a second width, said second width being less than said first width, said first width being between 0.5 and 1 mm, and such that said elongated fusible conductors are spaced apart a distance equal to at least twice their first widths.

11. The method as defined in claim 10, including the step of (c) subjecting said elongated support body with elongated fusible conductors printed thereon to a galvanic deposition process so as to provide a predetermined thickness of each of said elongated fusible conductors of up to 50 μm.

* * * * *